US009966036B2

(12) United States Patent
Jeong et al.

(10) Patent No.: US 9,966,036 B2
(45) Date of Patent: May 8, 2018

(54) DATA RENDERING METHOD AND DATA RENDERING DEVICE PERFORMING SUB PIXEL RENDERING

(71) Applicant: SAMSUNG DISPLAY CO., LTD., Yongin, Gyeonggi-Do (KR)

(72) Inventors: Geun-Young Jeong, Yongin (KR); Jong-Woong Park, Yongin (KR); Joo-Hyung Lee, Yongin (KR)

(73) Assignee: Samsung Display Co., Ltd., Yongin, Gyunggi-do (KR)

( * ) Notice: Subject to any disclaimer, the term of this patent is extended or adjusted under 35 U.S.C. 154(b) by 162 days.

(21) Appl. No.: 14/817,670

(22) Filed: Aug. 4, 2015

(65) Prior Publication Data

US 2015/0340007 A1 Nov. 26, 2015

Related U.S. Application Data

(62) Division of application No. 13/679,094, filed on Nov. 16, 2012, now Pat. No. 9,099,025.

(30) Foreign Application Priority Data

May 17, 2012 (KR) ..... 10-2012-0052638

(51) Int. Cl.
*G09G 5/02* (2006.01)
*G09G 3/20* (2006.01)
(Continued)

(52) U.S. Cl.
CPC ..... *G09G 5/02* (2013.01); *G09G 3/2003* (2013.01); *G09G 3/3258* (2013.01); *G09G 5/04* (2013.01);
(Continued)

(58) Field of Classification Search
CPC ..... G09G 5/02; G09G 5/04; G09G 3/2003; G09G 3/3258; G09G 2300/0452;
(Continued)

(56) References Cited

U.S. PATENT DOCUMENTS 6,950,115 B2 9/2005 Elliott
7,728,802 B2 6/2010 Elliott
(Continued)

FOREIGN PATENT DOCUMENTS

KR 10-2009-0122307 A 11/2009
WO WO 2005/104082 A2 11/2005
WO WO 2006/107979 A2 10/2006

*Primary Examiner* — King Poon
*Assistant Examiner* — Vincent Peren
(74) *Attorney, Agent, or Firm* — Lee & Morse, P.C.

(57) ABSTRACT

A plurality of data signals to be supplied to a first pixel and a second pixel formed by a first sub-pixel, two second sub-pixels, and two third sub-pixels on the display panel are rendered. Input data corresponding to a first sampling window with respect to the second sub-pixel of the first pixel among the input data applied to the stripe pattern is used to render a second data signal supplied to the second sub-pixel through filtering sampled input data for a color of the second sub-pixel. The first data signal to be supplied to the first sub-pixel is rendered through filtering of the input data of a second window unit for a color of the first sub-pixel with respect to the first sub-pixel of the first pixel among the sampled input data.

8 Claims, 11 Drawing Sheets

(51) Int. Cl.
*G09G 3/32* (2016.01)
*G09G 3/3258* (2016.01)
*G09G 5/04* (2006.01)

(52) U.S. Cl.
CPC ..... *G09G 2300/0452* (2013.01); *G09G 2340/0457* (2013.01)

(58) Field of Classification Search
CPC ... G09G 2300/0439; G09G 2300/0443; G09G 2340/0457
See application file for complete search history.

(56) References Cited

U.S. PATENT DOCUMENTS

| | | | | |
|---|---|---|---|---|
| 2003/0034992 | A1* | 2/2003 | Brown Elliott | G06T 3/4015 345/690 |
| 2003/0071943 | A1 | 4/2003 | Choo et al. | |
| 2003/0085906 | A1* | 5/2003 | Elliott | G09G 3/20 345/613 |
| 2003/0103058 | A1* | 6/2003 | Hellen Brown Elliott | G09G 3/20 345/589 |
| 2004/0239837 | A1 | 12/2004 | Hong et al. | |
| 2005/0001542 | A1 | 1/2005 | Kiguchi | |
| 2008/0049048 | A1* | 2/2008 | Credelle | G09G 3/2074 345/690 |
| 2010/0045695 | A1* | 2/2010 | Brown Elliott | G09G 3/2003 345/589 |

* cited by examiner

DATA RENDERING METHOD AND DATA RENDERING DEVICE PERFORMING SUB PIXEL RENDERING

CROSS-REFERENCE TO RELATED APPLICATIONS

This is a divisional application based on pending application Ser. No. 13/679,094, filed Nov. 16, 2012, the entire contents of which is hereby incorporated by reference.

This application claims priority under 35 U.S.C. §119 to and the benefit of Korean Patent Application No. 10-2012-0052638 filed in the Korean Intellectual Property Office on May 17, 2012, the entire contents of which are incorporated herein by reference.

BACKGROUND

1. Field of the Invention

Embodiments provide a data rendering method to generate a plurality of data signals of a plurality of sub-pixels forming a display panel, and a data rendering device.

2. Description of the Related Art

A pixel of a conventional display is generally realized by a sub-pixel of a rectangular shape. Accordingly, a pixel circuit and a light emitting portion of the sub-pixel are implanted with the same rectangular shape in the sub-pixel.

FIG. 1 is a view of a conventional display panel having a rectangular shape sub-pixel. As shown in FIG. 1, in the pixel having the rectangular shape sub-pixel, data are simultaneously supplied to the pixel circuit of a plurality of sub-pixels through a plurality of source wires, while it is optimal for this operation to be sequentially performed.

A plurality of gate wires transmits a plurality of scan signals of a gate-on voltage sequentially supplied from the gate scan circuit to the pixel circuit of a plurality of sub-pixels, and a plurality of source wires transmit a plurality of source signals supplied from the source driving IC to the pixel circuit of a plurality of sub-pixels.

To improve luminance and life-span of the display panel compared with resolution and power consumption, various sub-pixel rendering pixel structures with different shapes and number of sub-pixels have been proposed.

To improve image quality compared with an efficient pixel arrangement and unit pixel number, sub-pixels having a triangle shape, a rhombus shape, etc., may be used. However, in the display panel formed of sub-pixels with these shapes, the arrangement of the pixel circuit used in display panels having conventional rectangular shape sub-pixels must be changed.

FIG. 2 is a view showing a pixel structure of a rectangular shape according to a conventional stripe pattern and a sub-pixel rendering pixel structure (hereinafter, an SPR structure). The sub-pixel rendering pixel structure shown in FIG. 2 is referred to as an SPR1 structure.

As shown in FIG. 2, in the stripe or straight pattern, red, green, and blue sub-pixels are arranged with a rectangular shape. The number of sub-pixels if the SPR1 for the same area is decreased to 5/12 compared with the number of sub-pixels in the stripe pattern. The shape of each sub-pixel also has a special shape, such as triangle or a rhombus.

FIG. 3 is a view of a display panel formed with a conventional SPR1 pixel structure. As shown in FIG. 3, if the gate wire and the source wire are connected according to the pixel circuit of the SPR1 pixel structure, a number of gate wires is increased to 1.5 times that of the conventional stripe method, and the number of sub-pixels driven per gate wire is not constant. When the number of the sub-pixels driven per gate wire is not constant, an output voltage and a current of an amplifier connected to the gate line are different for each gate line such that display image quality is deteriorated. Also, as shown in FIG. 3, complexity of the wire arrangement due to the increase of the number of gates wire is increased.

The above information disclosed in this Background section is only for enhancement of understanding of the background of embodiments and therefore it may contain information that does not form the prior art that is already known in this country to a person of ordinary skill in the art.

SUMMARY

A data rendering method according to an exemplary embodiment renders a plurality of data signals controlling light emitting of a first pixel and a second pixel including one first sub-pixel, two second sub-pixels, and two third sub-pixels.

In detail, the rendering method includes sampling input data corresponding to a first sampling window with respect to the second sub-pixels of the first pixel among the input data applied to a stripe pattern; rendering the second data signal of the second sub-pixel through filtering of the sampled input data for a color of the second sub-pixel; and rendering the first data signal of the first sub-pixel through filtering of the input data of the second window unit for a color of the first sub-pixel with respect to the first sub-pixel of the first pixel among the sampled input data.

A period for rendering the second data signal and a period for rendering the first data signal may temporally overlap each other.

The data rendering method may further include: sampling the input data corresponding to the third sampling window with respect to the third sub-pixel of the first pixel among the input data applied to the stripe pattern; and rendering the third data signal of the third sub-pixel through the filtering of the sampled input data for the color of the third sub-pixel.

The data rendering method may further include: sampling the input data corresponding to the fourth sampling window with respect to the third sub-pixel of the second pixel among the input data applied to the stripe pattern; rendering the third data signal of the third sub-pixel through the filtering of the sampled input data for the color of the third sub-pixel; and rendering the first data signal of the first sub-pixel of the second pixel with respect to the first sub-pixel of the second pixel among the sampled input data through the filtering of the input data of the fifth window unit for the color of the first sub-pixel filtering.

The period for rendering the third data signal and the period for rendering the first data signal may temporally overlap.

A display panel according to an exemplary embodiment includes: a first gate wire transmitting a first scan signal and formed in a first direction; a second gate wire transmitting a second scan signal and formed in the first direction; first to fifth source wires respectively transmitting first to fifth video signals according to first to fifth data signals, formed according to a second direction different from the first direction, and positioned according to the first direction; first to fifth sub-pixels respectively including a pixel circuit connected to a corresponding one among the first to the fifth source wires and the first gate wire; and sixth to tenth sub-pixels respectively including a pixel circuit connected to a corresponding one of the first to fifth source wires and the second gate wire, wherein the second sub-pixel includes the pixel circuit connected to the first gate wire and the second source wire, the ninth sub-pixel includes the pixel circuit connected to the second gate wire and the fourth source wire, the second sub-pixel and the ninth sub-pixel display the same color, the first sub-pixel and seventh sub-pixel and the third sub-pixel and sixth sub-pixel are positioned in a diagonal direction with respect to the second sub-pixel, and the fourth sub-pixel and tenth sub-pixel and the eighth sub-pixel and fifth sub-pixel are positioned in a diagonal direction with respect to the ninth sub-pixel.

The first sub-pixel may include the pixel circuit connected to the first source wire and the first gate wire, and the sixth sub-pixel may include the pixel circuit connected to the first source wire and the second gate wire.

The third sub-pixel may include the pixel circuit connected to the third source wire and the first gate wire, and the eighth sub-pixel may include the pixel circuit connected to the third source wire and the second gate wire.

The fifth sub-pixel may include the pixel circuit connected to the fifth source wire and the first gate wire, and the tenth sub-pixel may include the pixel circuit connected to the fifth source wire and the second gate wire.

The seventh sub-pixel may include the pixel circuit connected to the second source wire and the second gate wire, and the fourth sub-pixel may include the pixel circuit connected to the fourth source wire and the first gate wire.

The first, second, third, sixth, and seventh sub-pixels may form one first pixel, and the fourth, fifth, eighth, ninth, and the tenth sub-pixels may form the second pixel, and the first pixels and the second pixels may be formed with a quadrangle shape.

The second sub-pixel may be formed at a first rhombus connecting a center of each edge of the first quadrangle of the first pixel, and the first, third, sixth, and seventh sub-pixels may be formed at a right triangle in the first quadrangle except for the first rhombus.

The ninth sub-pixel may be formed at a second rhombus connecting the center of each edge of the second quadrangle including the second pixel, and the fourth, fifth, eighth, and the tenth sub-pixels may be formed at four right triangles in the second quadrangle except for the second rhombus.

The pixel circuit of the second sub-pixel may be formed at a vertex of the first rhombus adjacent to the first gate wire, and the pixel circuit of the seventh sub-pixel may be formed at a right vertex of a right triangle where the seventh sub-pixel may be formed.

The pixel circuit of the third sub-pixel may be formed at the right vertex of the right triangle where the third sub-pixel is formed, and the pixel circuit of the eighth sub-pixel may be formed at the right vertex of the right triangle where the eighth sub-pixel may be formed.

The pixel circuit of the fourth sub-pixel may be formed at the right vertex of the right triangle where the fourth sub-pixel is formed, and the pixel circuit of the ninth sub-pixel may be formed at the vertex of the second rhombus adjacent to the second gate wire.

The second sub-pixel may be formed at the first rectangular shape at the center of the first quadrangle where the first pixel is formed, and the first, third, sixth, and seventh sub-pixels may be formed at four quadrangles that are divided into two regions in the first quadrangle except for the first rectangular shape.

The ninth sub-pixel may be formed at the second rectangular shape at the center of the second quadrangle where the second pixel is formed, and the fourth, fifth, eighth, and tenth sub-pixels may be formed at four quadrangles that are divided into two region in the second quadrangle except for the second rectangular shape.

The pixel circuit of the second sub-pixel may be positioned at the right-upper side of the first rectangular shape, and the pixel circuit of the seventh sub-pixel may be positioned at the left-lower side of the quadrangle where the seventh sub-pixel is formed.

The pixel circuit of the third sub-pixel may be positioned at the right-upper side of the quadrangle where the third sub-pixel is formed, and the pixel circuit of the eighth sub-pixel may be positioned at the left-lower side of the quadrangle where the eighth sub-pixel is formed.

The pixel circuit of the ninth sub-pixel may be positioned at the left-lower side of the second rectangular shape, and the pixel circuit of the fourth sub-pixel may be positioned at the right-upper side of the quadrangle where the fourth sub-pixel is formed.

A data rendering device according to an exemplary embodiment renders a data signal for a first sub-pixel of a first color, a second sub-pixel and a third sub-pixel of a second color positioned in a diagonal direction with respect to the first sub-pixel, and a fourth sub-pixel and a fifth sub-pixel of a third color positioned in the other diagonal direction with respect to the first sub-pixel by using input data for a plurality of pixels arranged with a stripe pattern.

The data rendering device may include: a line buffer portion storing the input data by a number of lines to generate the data signal; a sampling unit reading the input data from the line buffer portion to sample by a sampling window unit of a predetermined unit and generating sampling data while the sampling window is sequentially shifted by the pixel unit; and a rendering unit second color-filtering the first sampling data among the sampling data that are sequentially generated to generate the second data signal, third color-filtering the second sampling data next to the first sampling data among the sampling data to generate a third data signal, and first color-filtering the third sampling data included in one of the first sampling data and the second sampling data to generate the first data signal.

The line buffer portion may include a plurality of line buffers, a plurality of line buffers respectively store the input data by the line unit, and a line number of the plurality of line buffers is smaller than a line number of the sampling window by one. The sampling unit may sample the input data included in the sampling window among the input data stored to a plurality of line buffers and the input data included in the sampling window among the input data that is currently input to generate the sampling data.

The window to generate the first data signal may be smaller than the sampling window to generate the second and third data signals.

A period for rendering the first data signal may at least partially overlap a period for rendering one of the second data signal and the third data signal.

The rendering unit may include the rendering unit including: a first filter second color-filtering the first sampling data to render the second data signal and third-color filtering the second sampling data to render the third data signal; a second filter first-color filtering one of the first sampling data and the second sampling data to render the first data signal, and the period in which the first filter is operated and the period in which the second filter is operated are at least partially overlapped.

The second filter may be included in one of the first sampling data and the second sampling data, and second-color filters the input data of the window unit smaller than the size of the sampling window adjacent to the first sub-pixel.

When the pixel circuit of the first sub-pixel, the pixel circuit of the second sub-pixel, and the pixel circuit of the fourth sub-pixel are connected to the first gate wire, and the pixel circuit of the third sub-pixel and the pixel circuit of the fifth sub-pixel are connected to the second gate wire next to the first gate wire, the period in which the first filter renders the second data signal and the period in which the second filter renders the first data signal may at least partially overlap.

When the pixel circuit of the second sub-pixel and the pixel circuit of the fourth sub-pixel are connected to the first gate wire, and the pixel circuit of the first sub-pixel, the pixel circuit of the third sub-pixel, and the pixel circuit of the fifth sub-pixel are connected to the second gate wire next to the first gate wire, the period in which the first filter renders the third data signal and the period in which the second filter renders the first data signal may at least partially overlap.

DETAILED DESCRIPTION

Figure 1:
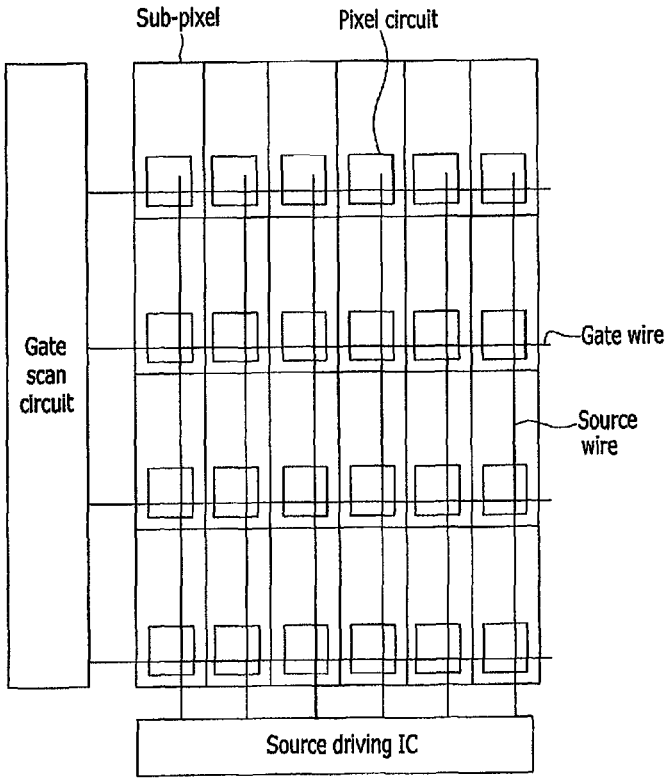
RELATED ART FIG. 1
FIG. 1 is a view of a display panel realized by a conventional rectangular sub-pixel.

In the following detailed description, only certain exemplary embodiments have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 4:
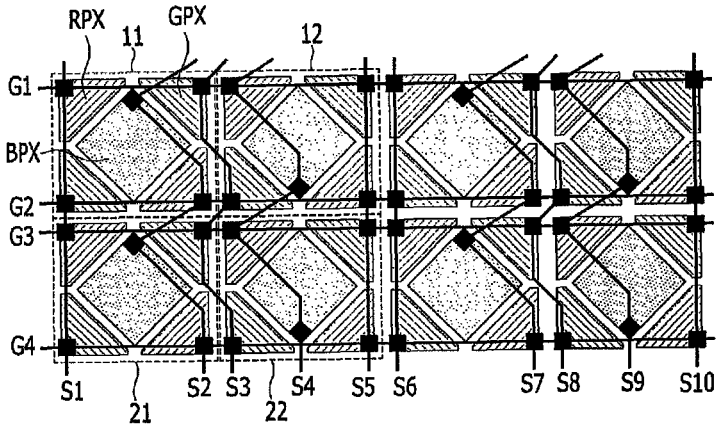
FIG. 4 shows a portion of a display panel according to an SPR structure according to an exemplary embodiment.

FIG. 4 is a portion of a display panel according to an SPR structure according to an exemplary embodiment. FIG. 4 show a portion of the display panel including four gate wires and ten source wires in the entire display panel. A scan signal is transmitted through the gate wires and a video signal is transmitted through the source wires.

The pixel of the SPR structure according to an exemplary embodiment of the present invention has a structure in which one blue sub-pixel BPX, two red sub-pixels RPX, and two green sub-pixels GPX are disposed in a quadrangle. The blue sub-pixel BPX is disposed in a rhombus region connecting four edges of the quadrangle, and the two red sub-pixels RPX and the two green sub-pixels GPX are disposed in four right triangle regions where the rhombus is subtracted from the quadrangle. In detail, two red sub-pixels RPX are positioned in a diagonal direction of the quadrangle with reference to the blue sub-pixel BPX, and two green sub-pixels GPX are positioned in another diagonal direction of the quadrangle with reference to the blue sub-pixel BPX.

Each pixel circuit of the red sub-pixel RPX and the green sub-pixel GPX may be positioned at one of vertices of the right triangle. The pixel circuit of the blue sub-pixel BPX may be positioned at one of vertices of the rhombus.

In FIG. 4, a block indicated by a black color in the sub-pixel area represents the pixel circuit of each sub-pixel. Each pixel circuit of the red sub-pixel RPX and the green sub-pixel GPX may be positioned at the right vertex of the right triangle, and the pixel circuit of the blue sub-pixel BPX may be positioned at the vertex of the rhombus that may be connected to the same gate wire as the red sub-pixel RPX and the green sub-pixel GPX. Here, the positions of the pixel circuits of two adjacent blue sub-pixels BPX in the same pixel row are different from each other, as a unit of two pixel rows, and the position of the pixel circuit of the blue sub-pixel BPX is repeated.

For example, as shown in FIG. 4, if the position of one pixel circuit among two adjacent blue sub-pixels BPX is positioned at an upper end vertex of the rhombus, the position of the other one pixel circuit is positioned at a lower end vertex of the rhombus.

As described above, considering the position of the pixel circuit of each sub-pixel, a basic pattern of the display panel realized by the pixel of the SPR1 structure is 2×1. That is, two pixels of the 2×1 pattern are repeated in the vertical direction and the horizontal direction. The pixel circuits of ten sub-pixels forming the basic pattern 2×1 are respectively connected to a corresponding one of two gate wires G1 and G2 and a corresponding one among ten source wires S1-S10.

Figure 5:
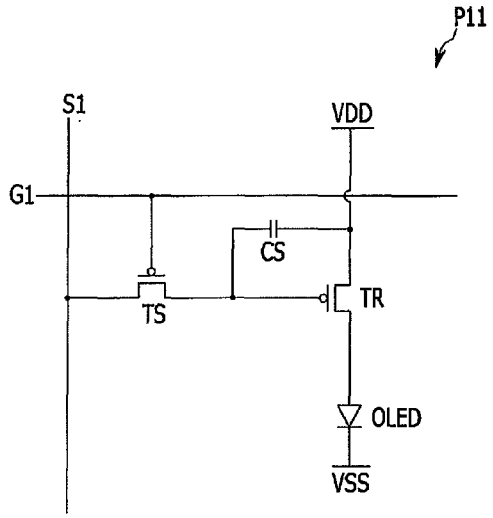
FIG. 5 is a view of a pixel circuit according to an exemplary embodiment.

FIG. 5 is a view of a pixel circuit according to an exemplary embodiment of the present invention. FIG. 5 shows the pixel circuit P11 of the red sub-pixel RPX connected to the gate wire G1 and the source wire S1 is connected to the organic light emitting diode (OLED). As shown in FIG. 5, the pixel circuit P11 includes a switching transistor TS, a driving transistor TR, and a storage capacitor CS.

A cathode of the organic light emitting diode (OLED) is connected to a voltage VSS. The switching transistor TS includes a gate electrode connected to the gate wire G1, a first electrode connected to the source wire S1, and a second electrode.

The driving transistor TR includes a gate electrode connected to the switching transistor TS, a second electrode connected to a source electrode voltage VDD, and a drain electrode connected to the anode of the organic light emitting diode (OLED). The storage capacitor CS is connected between the gate electrode and the source electrode of the driving transistor TR.

When the switching transistor TS is turned on by the scan signal of the gate-on voltage transmitted through the gate wire G1, the gate electrode of the driving transistor TR receives the video signal transmitted through the source wire S1. The voltage according to the video signal transmitted to the gate electrode of the driving transistor TR is maintained by the storage capacitor CS.

Thus, the driving current depending on the voltage maintained by the storage capacitor CS flows to the driving transistor TR. This driving current flows to the organic light emitting diode (OLED), and the organic light emitting diode (OLED) emits light with a luminance depending on the driving current.

Two pixels 11 and 12 adjacent in the row direction among a plurality of pixels are respectively connected to the same two gate wires G1 and G2, and two source wires S4 and S5 among three source wires S3, S4, and S5 connected to one pixel 12 of two pixels and two source wires S1 and S2 among three source wires S1, S2, and S3 connected to the other one pixel 11 are different from each other. Two pixels 11 and 12 adjacent in the row direction share one source wire S3.

Two pixels 11 and 21 adjacent in the column direction among a plurality of pixels are respectively connected to three source lines S1, S2, and S3, and two gate wires G3 and G4 connected to one pixel 21 of two pixels are different from two gate wire G1 and G2 connected to the other pixel 11.

As shown in FIG. 4, an interval between the gate wires G1-G4 is determined according to the position of the pixel circuit of each corresponding sub-pixel, and each shape of the source wires S1-S10 is determined according to the position of the pixel circuit of each sub-pixel.

In the basic 2×1 pattern, the pixel circuit of the blue sub-pixel BPX of the pixel 11 positioned at the left side is positioned at a rhombus upper vertex that may be connected to the same gate wire G1 as each pixel circuit of the red sub-pixel RPX positioned at a left upper end the green sub-pixel GPX positioned at a right upper end.

In contrast, the pixel circuit of the blue sub-pixel BPX of the pixel 12 positioned at the right side in the basic pattern 2×1 is positioned at the rhombus lower vertex that may be connected to the same gate wire G2 as each pixel circuit of the green sub-pixel GPX positioned at the left lower end and the red sub-pixel RPX positioned at the right lower end.

The basic pattern may be repeated such that the pixel circuit of the blue sub-pixel BPX of the pixel 21 is positioned at the rhombus upper vertex that may be connected to the same gate wire G3 as each pixel circuit of the red sub-pixel RPX positioned at the left upper end and the green sub-pixel GPX positioned at the right upper end. Also, the pixel circuit of the blue sub-pixel BPX of the pixel 22 is positioned at the rhombus lower vertex that may be connected to the same gate wire G4 as each pixel circuit of the green sub-pixel GPX positioned at the left lower end and the red sub-pixel RPX positioned at the right lower end.

One blue sub-pixel, two red sub-pixels, and two green sub-pixels forming the pixel may be defined according to position as follows. The first red sub-pixel, the first green sub-pixel, and the first blue sub-pixel may be connected to the odd-numbered gate wires G1 and G3, and the second red sub-pixel, the second green sub-pixel, and the second blue sub-pixel may be connected to the even-numbered gate wires G2 and G4.

This definition is only for better understanding and ease of description, and does not limit exemplary embodiments. Furthermore, to divide the sub-pixels of the same color, each sub-pixel is divided by defining a number of the gate wire and a number of the source wire to which each sub-pixel is connected as a coordinate.

The source wire S1 is connected to the pixel circuit of the first red sub-pixel 1 and 1, the first green sub-pixel 2 and 1, the first red sub-pixel 3 and 1, and the second green sub-pixel 4 and 1, and is formed in the pixel column direction.

The source wire S2 is connected to the pixel circuit of the first blue sub-pixel 1 and 2, the second red sub-pixel 2 and 2, the first blue sub-pixel 3 and 2, and the second red sub-pixel 4 and 2 with a zigzag, thereby forming an "S" pattern.

The source wire S3 is connected to the pixel circuit of the first green sub-pixel 1 and 3, the second green sub-pixel 2 and 3, the first green sub-pixel 3 and 3, and the second green sub-pixel 4 and 3 with the zigzag, thereby forming an "S" pattern.

The source wire S4 is connected to the pixel circuit of the first red sub-pixel 1 and 4, the second blue sub-pixel 2 and 4, the first red sub-pixel 3 and 4, and the second blue sub-pixel 4 and 4 with the zigzag, thereby forming an "S" pattern.

The source wire S5 is connected to the pixel circuit of the first green sub-pixel 1 and 5, the second red sub-pixel 2 and 5, the first green sub-pixel 3 and 5, and the second red sub-pixel 4 and 5, and is formed in the pixel column direction.

The source wires S6-S10 respectively have the same connection relationship and shape as the source wires S1-S5, and the source wires with the same connection relationships are formed with the same pattern by units of five.

In the basic pattern 2×1, the number of sub-pixels connected to the odd-numbered gate wires G1 and G3 is 5, and the number of the sub-pixels connected to the even-numbered gate wires G2 and G4 is also 5. In the display panel according to an exemplary embodiment, the basic pattern 2×1 is repeated in the row direction and the column direction such that the number of sub-pixels connected to all gate wires is the same.

As described, the number of sub-pixels connected per gate wire is the same such that the image quality deterioration may be reduced or prevented. Furthermore, compared with the conventional art shown in FIG. 3, the number of sub-pixels connected per gate wire is increased such that the total number of the gate wires may be reduced.

Also, a plurality of source wires through which the video signal is not transmitted are not generated among the plurality of source wires. In detail, in the conventional art shown in FIG. 3, during a scan period in which the gate on voltage is transmitted to the first gate wire, the video signal is not supplied to the 2nd, 5th, 8th, and (3k−1)th source wires. Also, during a scan period in which the gate on voltage is transmitted to the second gate wire, the video signal is only supplied to the (3k−1)th source wire.

That is, in the conventional art, a plurality of source wires through which the video signal is not transmitted exists among a plurality of source wires according to the odd-numbered gate wires and the even-numbered gate wires. However, in an exemplary embodiment, during the scan period, a plurality of video signals may be transmitted through all source wires.

Figure 3:
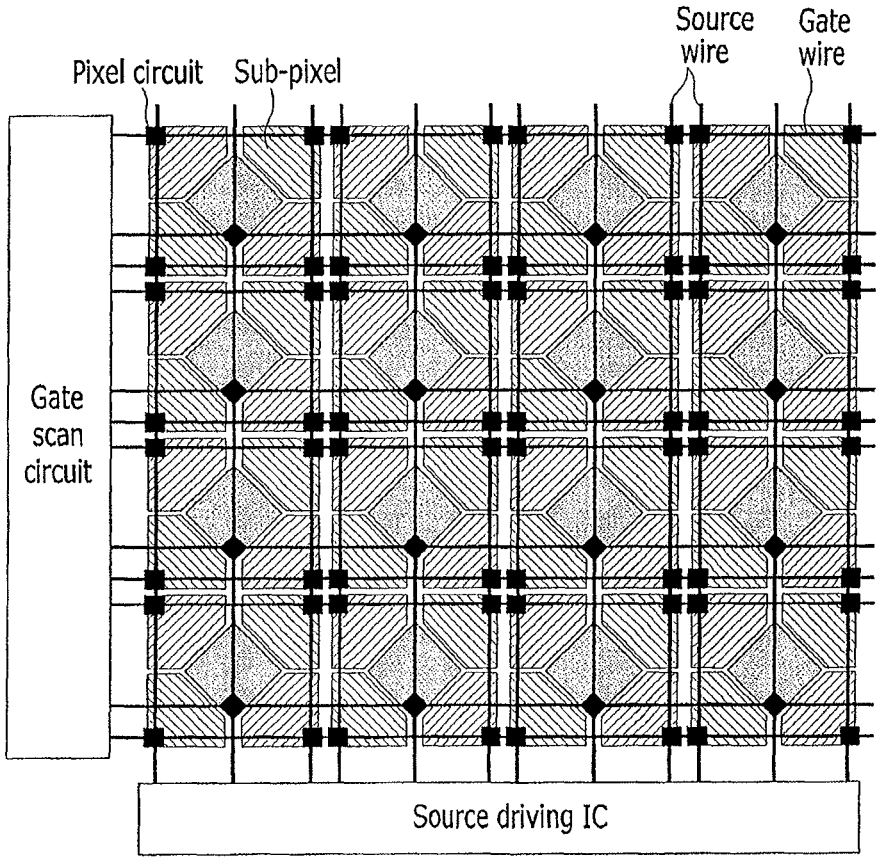
RELATED ART FIG. 3
FIG. 3 is a view showing a display panel formed of a conventional SPR1 pixel structure.

Also, compared with the conventional art shown in FIG. 3, the number of source wires is reduced. The decreased number of gate wires and source wires may improve the aperture ratio.

Figure 6:
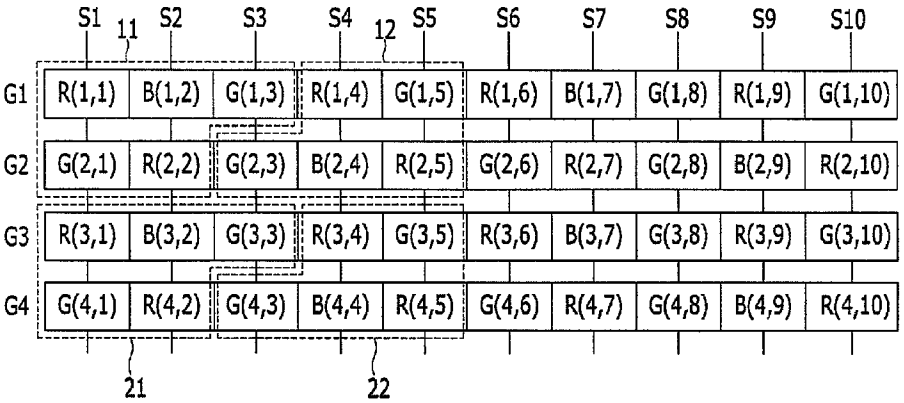
FIG. 6 is a view of data signals corresponding to video signals respectively transmitted through source wires to a plurality of sub-pixels connected to gate wires.

FIG. 6 is a view of data signals corresponding to video signals respectively transmitted through source wires to a plurality of sub-pixels connected to gate wires.

The data signal as a signal for controlling the light emitting of the corresponding sub-pixel is changed into the video signal through a driving IC driver (not shown). The video signal may be a voltage depending on the data signal or a current signal.

The video signal transmitted to the pixel circuit of the sub-pixel shown in FIG. 5 is the voltage signal.

As shown in FIG. 6, a plurality of data signals are arranged according to the gate wires and the source wires. For the description of the exemplary embodiment, a plurality of data signals arranged according to four gate wires and ten source wires are shown, however embodiments are not limited thereto.

The data signal controlling the light emitting of the red sub-pixel of the SPR structure is indicated by 'R', the data signal controlling the light emitting of the green sub-pixel of the SPR structure is indicated by 'G', and the data signal controlling the light emitting of the blue sub-pixel of the SPR structure is indicated by 'B', and to divide the data signals, the coordinates of each sub-pixel shown in FIG. 4 are represented together.

Thus, as shown in FIG. 6, each data signal may be defined by a color and a corresponding sub-pixel. In addition, a period in which the gate on voltage is supplied to the gate wire is referred to as the scan period.

The data signals of five sub-pixels forming one pixel include the data signals (for example, R (1 and 1), B (1 and 2), and G (1 and 3)) representing the video signals supplied during the scan period of the corresponding gate wire (for example, G1) among the odd-numbered gate wires and the data signals (for example, G (2 and 1) and R (2 and 2)) representing the video signals supplied during the scan period of the corresponding gate wire (for example, G2) among the even-numbered gate wires.

That is, five data signals of the pixel 11 are R (1 and 1), B (1 and 2), G (1 and 3), G (2 and 1), and R (2 and 2), and five data signals of the pixel 12 are R (1 and 4), G (1 and 5), G (2 and 3), B (2 and 4), and R (2 and 5). Also, five data signals of the pixel 21 are R (3 and 1), B (3 and 2), G (3 and 3), G (4 and 1), and R (4 and 2), and five data signals of the pixel 22 are R (3 and 4), G (3 and 5), G (4 and 3), B (4 and 4), and R (4 and 5).

By this method, a plurality of scan periods are sequentially generated and, during each scan period, if a plurality of video signals according to a plurality of data signals are supplied through the source wires, a source wire through which the video signal is not supplied every plurality of scan periods does not exist.

The SPR1 structure includes one rhombus positioned at a center of the quadrangle region and four right triangles. However, exemplary embodiments are not limited thereto, and various variations are possible. For example, the quadrangle region formed with five rectangular shapes will be described.

Figure 7:
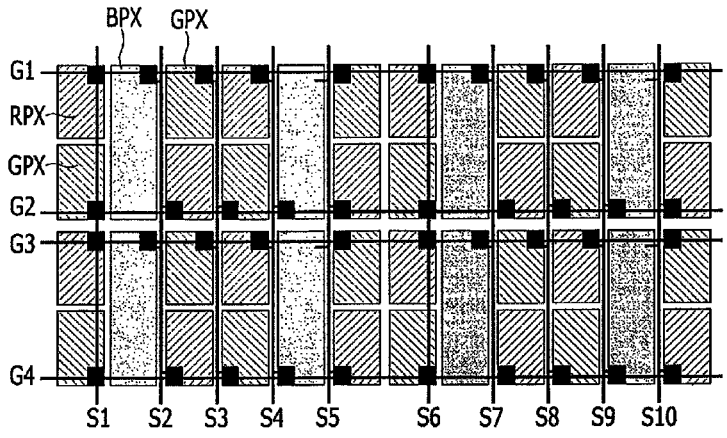
FIG. 7 is a view of a pixel having another SPR2 structure as an exemplary variation of an exemplary embodiment.

FIG. 7 is a view showing a pixel having another SPR2 structure, as an exemplary variation of an exemplary embodiment. The pixel of the SPR2 structure also has a structure in which one blue sub-pixel BPX, two red sub-pixels RPX, and two green sub-pixels GPX are disposed in a quadrangle.

The blue sub-pixel BPX is disposed at the rectangular shape region positioned at the center of the quadrangle, and two red sub-pixels RPX and two blue sub-pixels BPX are divided into the rectangular shape at two remaining regions other than the center rectangular shape in the quadrangle. In detail, two red sub-pixels RPX are disposed at the right/left sides with reference to the blue sub-pixel BPX, one disposed at the left side is positioned at the upper end, and the other one disposed at the right side is positioned at the lower end, i.e., along a diagonal there through. Two green sub-pixels GPX are disposed at the right/left sides with reference to the blue sub-pixel BPX, one disposed at the left side is positioned at the lower end, and the other one disposed at the right side is positioned at the upper end, i.e., along a diagonal there through.

Each pixel circuit of the blue sub-pixel BPX, the red sub-pixel RPX, and the green sub-pixel GPX may be positioned at one among the vertices of the rectangular shape.

In this case, as shown in FIG. 7, in the pixel 21, the pixel circuit of the red sub-pixel RPX positioned at the left-upper side is positioned at the right-upper side of the rectangular shape, and the pixel circuit of the red sub-pixel RPX positioned at the right-lower side is positioned at the left-lower side of the rectangular shape. In the pixel 21, the pixel circuit of the green sub-pixel GPX positioned at the left-lower side is positioned at the right-lower side of the rectangular shape, and the pixel circuit of the green sub-pixel GPX positioned at the right-upper side is positioned at the right-upper side of the rectangular shape. The pixel circuit of the blue sub-pixel BPX is positioned at the right-upper side.

In the pixel 22, the pixel circuit of the red sub-pixel RPX positioned at the left-upper side is positioned at the right-upper side of the rectangular shape, and the pixel circuit of the red sub-pixel RPX positioned at the right-lower side is positioned at the left-lower side of the rectangular shape. This is the same as the pixel 21. However, in the pixel 22, the pixel circuit of the green sub-pixel GPX positioned at the left-lower side is positioned at the left-lower side of the rectangular shape, and the pixel circuit of the green sub-pixel GPX positioned at the right-upper side is positioned at the left-upper side of the rectangular shape. The pixel circuit of the blue sub-pixel BPX is positioned at the left-lower side.

The basic 2×1 pattern including the pixel 21 and the pixel 22 is repeated such that the description of the pixel circuit arrangement of another pixel is omitted.

Alternatively, when the pixel circuit of the left-upper red sub-pixel RPX of the pixel 21 is positioned at the left-upper side, the pixel circuit of the left-lower green sub-pixel GPX may be positioned at the left-lower side. When the pixel circuit of the right-upper green sub-pixel GPX of the pixel 22 is positioned at the right-upper side, the pixel circuit of the right-upper red sub-pixel RPX may be positioned at the right-lower side.

In the pixel circuits of the sub-pixels arranged in FIG. 4, the sub-pixels of the same number are connected to the gate wires and the pixel circuits are disposed at the position to not generate a blank of the video signal transmitted to a plurality of source wires during the scan period. The pixel circuits of the sub-pixels arranged in FIG. 7 may be appropriately positioned for the same condition.

In an exemplary embodiment, a plurality of sub-pixels connected to the odd-numbered gate wire are repeatedly connected with the sequence of red, blue, green, red, and green according to the gate wire, and a plurality of the sub-pixels connected to the even-numbered gate wires are repeatedly connected with the sequence of green, red, green, blue, and red according to the gate wire. However, exemplary embodiments are not limited thereto. For example, the arrangement may be vice versa.

Also, while the pixel is illustrated as having the red sub-pixel positioned at the left-upper side and the right-lower side and the green sub-pixel positioned at the left-lower side and the right-upper side, this arrangement may be vice versa.

As a basic condition to be considered for the arrangement of the pixel circuit, 1) for the same number of sub-pixels connected to the gate wire, the gate wire may be connected to only the pixel circuit of the blue sub-pixel of one pixel among the basic 2×1 pattern. Also, 2) five source wires connected to the basic 2×1 pattern must be respectively connected to the pixel circuit of two sub-pixels among ten sub-pixels, one of five source wires always share two pixels, and the remaining four source wires may be connected two by two to the pixel circuit of the sub-pixel of each pixel.

The pixel circuit may be appropriately disposed at the position that is capable of minimizing a length of the wire while satisfying the two conditions above.

The arrangement of a plurality of data signals representing the video signals transmitted to a plurality of sub-pixels connected to the gate wire shown in FIG. 7 through the source wire is the same as that shown in FIG. 6 such that the detailed description is omitted.

Figure 2:
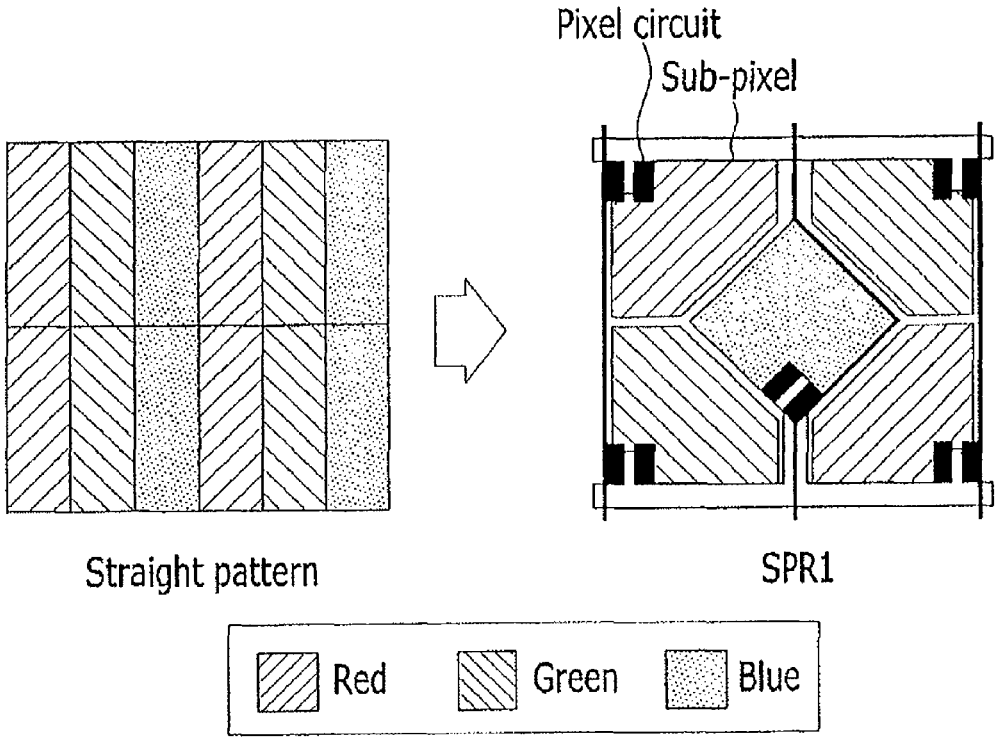
RELATED ART FIG. 2
FIG. 2 is a view showing a pixel structure of a rectangular shape according to a conventional stripe pattern and a sub-pixel rendering pixel structure (hereinafter, an SPR structure).

Next, a method of rendering a plurality of data signals according to an exemplary embodiment of the present invention will be described. Changing the input data according to the stripe pattern shown in FIG. 2 into the data signals according to the SPR (SPR1 or SPR2) structure is referred to as rendering.

Figure 8:
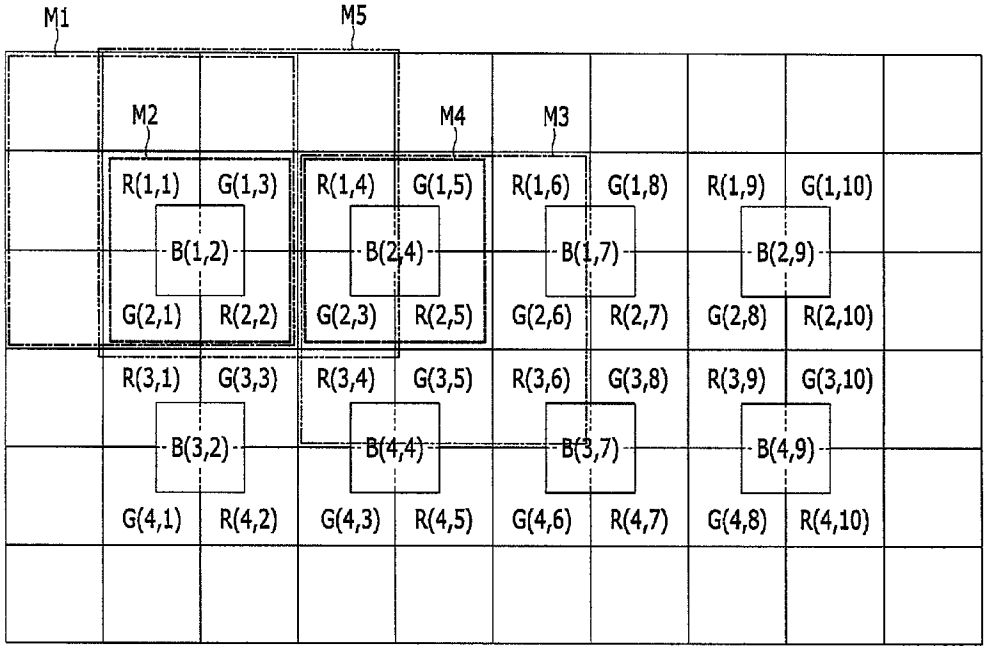
FIG. 8 is a view corresponding to data signals of a plurality of sub-pixels according to a plurality of pixel areas and an SPR structure according to a stripe pattern.

FIG. 8 is a view corresponding to data signals of a plurality of sub-pixels according to a plurality of pixel areas and an SPR structure according to a stripe pattern.

The quadrangle defined by a plurality of horizontal lines and a plurality of vertical lines shown in FIG. 8 indicates one pixel of a stripe pattern. For the vertical lines and the horizontal lines, a line portion overlapping the blue sub-pixel of the SPR structure is indicated by a dotted line. In the stripe pattern, one pixel includes RGB three sub-pixels (referring to FIG. 2).

Each data signal of a plurality of red sub-pixels and a plurality of green sub-pixels according to the SPR structure is rendered through color filtering of the corresponding sub-pixel of the input data corresponding to a sampling window of a predetermined size among a plurality of pixels arranged according to the stripe pattern with reference to the corresponding sub-pixel.

Hereafter, the sampling window means a group of sampling object pixels among the pixels according to the stripe pattern for rendering the data signal of the sub-pixel of the SPR structure. In an exemplary embodiment, the size of the sampling window is set as 3×3.

Each data signal of a plurality of blue sub-pixels according to the SPR structure is rendered through the filtering of the blue input data to be supplied to the 2×2 window with reference to the corresponding sub-pixel. The filtering method may be determined by a method of obtaining an average value of the corresponding input data.

This is one example, and exemplary embodiments are not limited thereto. For example, the filtering method and/or the size of the filtered window may be changed.

For example, the data signal R (1 and 1) of the first red sub-pixel RPX in the pixel 11 of FIG. 4 may be rendered by averaging the input data corresponding to nine red sub-pixels included in a 3×3 sampling window M1. The data signal B (1 and 2) of the blue sub-pixel BPX of the pixel 11 may be rendered by averaging the input data corresponding to four blue sub-pixels included in a 2×2 window M2.

The data signal R (2 and 5) of the second red sub-pixel RPX of the pixel 12 may be rendered by averaging the input data corresponding to nine red sub-pixels included in a 3×3 sampling window M3. The data signal B (2 and 4) of the blue sub-pixel BPX of the pixel 12 may be rendered by averaging the input data corresponding to four blue sub-pixels included in a 2×2 window M4.

The data signal G (1 and 3) of the first green sub-pixel GPX of the pixel 11 may be rendered by averaging the input data corresponding to nine green sub-pixels included in a 3×3 sampling window M5.

FIG. 8 shows the window for generating the data signal of the blue sub-pixel included in the sampling window for generating the data signal of the different color sub-pixel of the same pixel. That is, the 2×2 window M2 is commonly included in the 3×3 sampling window to generate the data signals R (1 and 1), G (1 and 3), G (2 and 1), and R (2 and 2). Accordingly, the operation of rendering the data signal of the blue sub-pixel may be simultaneously performed with the operation of rendering the data signal of the red or green sub-pixel.

Figure 9:
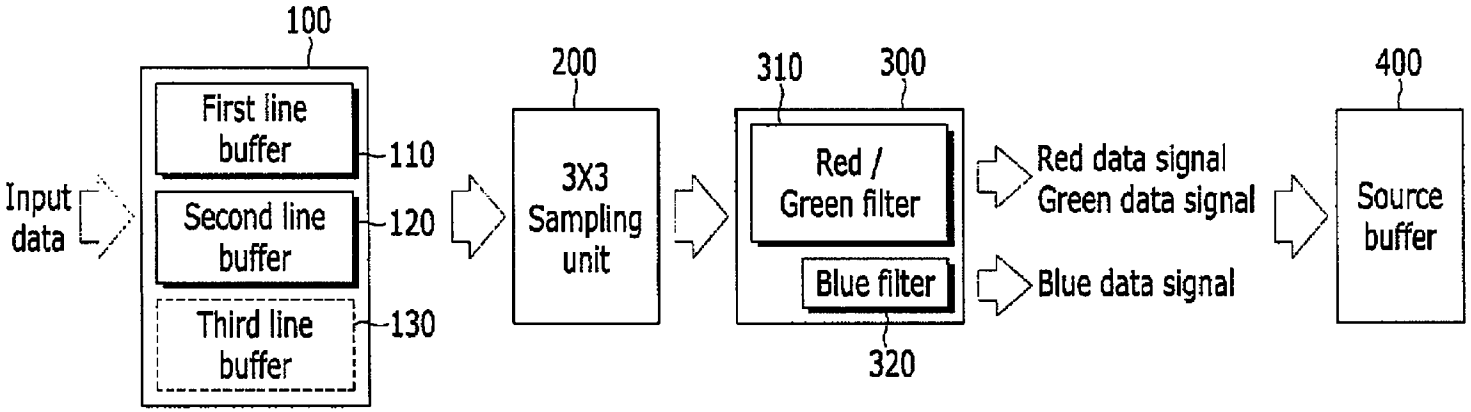
FIG. 9 is a view showing a data rendering device according to an exemplary embodiment.

FIG. 9 is a view of a data rendering device according to an exemplary embodiment. The data rendering device 10 includes a line buffer portion 100, a 3×3 sampling unit 200, a rendering unit 300, and a source buffer 400.

The line buffer portion 100 stores the input data by a line number for the rendering as a line unit. For example, to generate the data signal of the red and green sub-pixels, input data to be written to the 3×3 sampling window corresponding to each sub-pixel is required. Accordingly, the line buffer portion 100 stores the input data of at least two lines. The 3×3 sampling window is applied to the input data of two lines stored to the line buffer portion 100 and the input data that is currently input such that the line buffer of at least two lines exists.

At this time, the 3×3 sampling window corresponding to each sub-pixel means a group of a plurality of pixels arranged according to the stripe pattern with reference to the position of the corresponding sub-pixel, and the line unit means the arrangement of the input data for light-emitting a plurality of pixels forming one row.

As described above, the input data to generate the data signal of the blue sub-pixel is included in the input data to generate one among the red and green sub-pixels of the same pixel.

The line buffer portion 100 includes first and second line buffers 110 and 120. Each line buffer 110 and 120 sequentially stores the input data of the line unit. The third line 130 represents a current input data.

The 3×3 sampling unit 200 generates the sampling data by sampling the input data from the line buffer portion 100 by the 3×3 sampling window unit. The 3×3 sampling unit 200 samples the input data while sequentially moving the 3×3 sampling window by one pixel unit (in the stripe pattern, the pixel unit includes the RGB sub-pixels).

In detail, the sampling unit 200 sequentially reads each of the first and second line unit input data, respectively stored to the first and second line buffers 110 and 120, and the input data of the third line 130 that is currently input, and samples the input data of the 3×3 sampling window unit to generate the sampling data.

At this time, among the first line buffer 110 (or the second line buffer 120), instead of the input data applied with the 3×3 sampling window, the input data of the third line 130 that is currently input is stored.

Also, the 3×3 sampling unit 200 samples the input data included in the 3×3 sampling window that is moved by one pixel to generate a next sampling data. This operation is repeated.

The rendering unit 300 red-filters the sampling data corresponding to the red sub-pixel among the sampling data that are sequentially generated to generate the red data signal, green-filters the sampling data corresponding to the green sub-pixel to generate the green data signal, and blue-filters the sampling data corresponding to the blue sub-pixel to render the blue data signal. The rendering unit 300 includes a red/green filter 310 and a blue filter 320. In an exemplary embodiment, the red data signal and the green data signal are rendered through the 3×3 filtering, and do not overlap in time, thereby only using one filter. However, embodiments are not limited thereto.

The red/green filter 310 red-filters the sampling data to render the red data signal, and green-filters the sampling data different from the sampling data used for the red data signal to render the green data signal.

The red filter calculates the average of the input data representing red among the sampling data of the 3×3 sampling window unit corresponding to the red sub-pixel. The green filter calculates the average of the input data representing green among the sampling data of the 3×3 sampling window unit corresponding to the green sub-pixel.

The blue filter 320 blue-filters the input data of one 2×2 window unit among the sampling data used for the red filtering and the sampling data used for the green filtering to render the blue data signal. The blue filter 320 calculates the average of the input data representing blue among the input data of the 2×2 window unit adjacent to the blue sub-pixel among the sampling data used for the red filtering (or the green filtering).

The above generated red, green, and blue data signals are transmitted to the source buffer 400 to be stored.

Figure 10:
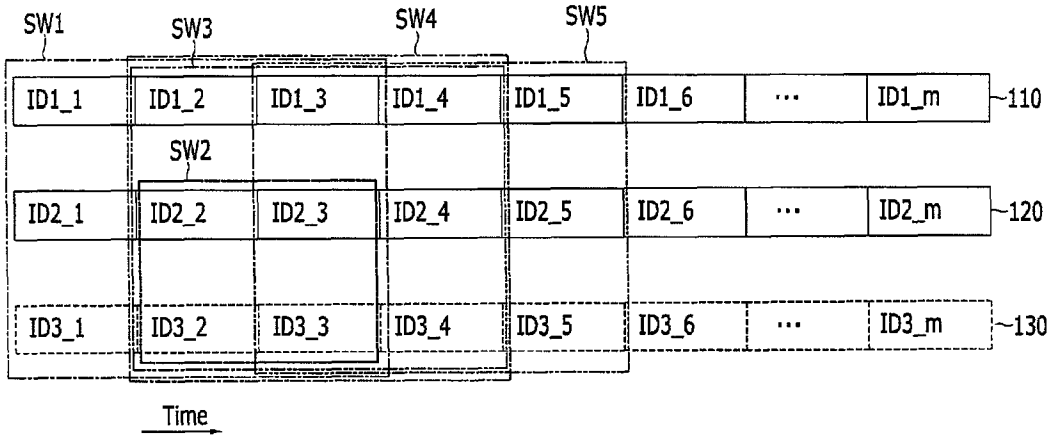
FIG. 10 is a view showing input data stored in a line buffer portion.
Figure 11:
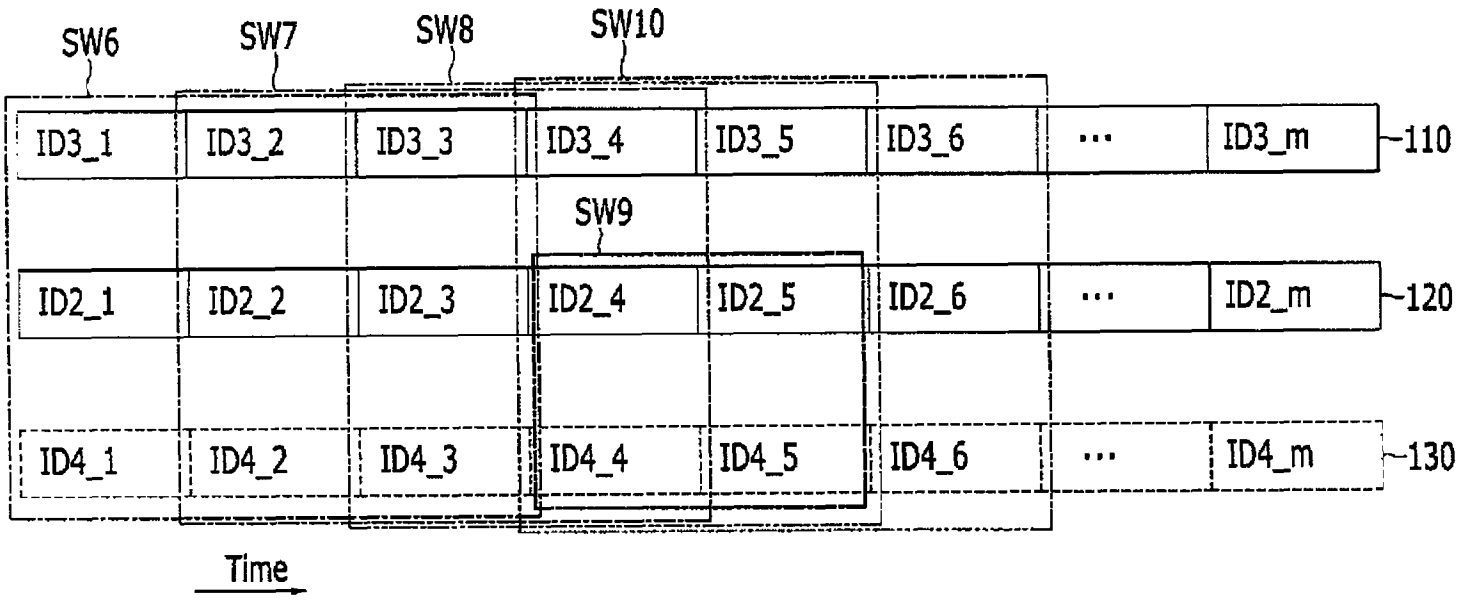
FIG. 11 is a view showing input data stored in a line buffer portion.

Next, an operation of the data rendering device will be described with reference to FIG. 10 and FIG. 11. FIG. 10 is a view showing input data stored in a line buffer portion.

As shown in FIG. 10, the first line buffer 110 is stored with m input data (ID1_1-ID1_*m*) of the first line, the second line buffer 120 is stored with m input data (ID2_1-ID2_*m*) of the second line, and the third line 130 indicated by the dotted line represents the arrangement of the input data (ID3_1-ID3_*m*) that are currently input.

The sampling unit 200 samples the input data (ID1_1, ID1_2, ID1_3, ID2_1, ID2_2, and ID2_3) included in the 3×3 sampling window SW1 among the input data stored to the first and second line buffers 110 and 120 to generate the red data signal R (1 and 1) and the input data (ID3_1, ID3_2, and ID3_3) of the third line 130 to generate the sampling data SD1.

The red/green filter 310 red filters the sampling data SD1 to render the red data signal R (1 and 1). At this time, the blue filter 320 blue filters the sampling data SD2 of the 2×2 sampling window SM2 among the sampling data SD1 to render the blue data signal B (1 and 2).

The sampling unit 200 samples the input data (ID1_2, ID1_3, ID1_4, ID2_2, ID2_3, and ID2_4) included in the 3×3 sampling window SW3 among the input data stored to the first and second line buffers 110 and 120 to generate the green data signal G (1 and 3) and the input data (ID3_2, ID3_3, and ID3_4) of the third line 130 to generate the sampling data SD3.

The red/green filter 310 green-filters the sampling data SD3 to render the green data signal G (1 and 3).

Next, the sampling unit 200 samples the input data (ID1_3, ID1_4, ID1_5, ID2_3, ID2_4, and ID2_5) included in the 3×3 sampling window SW4 among the input data stored to the first and second line buffers 110 and 120 to generate the red data signal R (1 and 4) and the input data (ID3_3, ID3_4, and ID3_5) of the third line 130 to generate the sampling data SD4.

The red/green filter 310 red filters the sampling data SD4 to render the red data signal R (1 and 4). At this time, the blue filter 320 does not use the input data of the 2×2 window unit among the sampling data SD4. The blue data signal B (2 and 4) is rendered when the input data of the next line is input to the line buffer portion 100.

Next, the sampling unit 200 samples the input data (ID1_4, ID1_5, ID1_6, ID2_4, ID2_5, and ID2_6) included in the 3×3 sampling window SW5 among the input data stored to the first and second line buffers 110 and 120 to generate the green data signal G (1 and 5) and the input data (ID3_4, ID3_5, and ID3_6) of the third line 130 to generate the sampling data SD5.

The red/green filter 310 green-filters the sampling data SD5 to render the green data signals G (1 and 5).

By this method, while the 3×3 sampling window is sequentially shifted by one pixel unit, the sampled sampling data is filtered with the corresponding color through the filters such that all data signals of one line of the SPR pixel structure are rendered.

Next, a method of generating the data signals of the next line will be described with reference to FIG. 11. FIG. 11 is a view showing input data stored in a line buffer portion.

Compared with FIG. 10, the first line buffer 110 stores the input data of the above-described third line 130, and the input data stored in the second line buffer 120 is the same. The third line 130 indicated by the dotted line represents the arrangement of the input data (ID1_4-IDm_4) that are currently input.

The sampling unit 200 samples the input data (ID2_1, ID2_2, ID2_3, ID3_1, ID3_2, and ID3_3) included in the 3×3 sampling window SW6 among the input data stored to the first and second line buffers 110 and 120 to generate the green data signal G (2 and 1) and the input data (ID4_1, ID4_2, and ID4_3) of the third line 130 to generate the sampling data SD6.

The red/green filter 310 green-filters the sampling data SD6 to render the green data signal G (2 and 1).

The sampling unit 200 samples the input data (ID2_2, ID2_3, ID2_4, ID3_2, ID3_3, and ID3_4) of the 3×3 sampling window SW7 among the input data stored to the first and second line buffers 110 and 120 to generate the red data signal R (2 and 2) and the input data (ID4_2, ID4_3, and ID4_4) of the third line 130 to generate the sampling data SD7.

The red/green filter 310 red filters the sampling data SD7 to render the red data signal R (2 and 2).

Next, the sampling unit 200 samples the input data (ID2_3, ID2_4, ID2_5, ID3_3, ID3_4, and ID3_5) included in the 3×3 sampling window SW8 among the input data stored to the first and second line buffers 110 and 120 to generate the green data signal G 2 and 3 and the input data (ID4_3, ID4_4, and ID4_5) of the third line 130 to generate the sampling data SD8.

The red/green filter 310 green-filters the sampling data SD8 to render the green data signal G (2 and 3). At this time, the blue filter 320 blue-filters the sampling data of the 2×2 window SW9 among the sampling data SD8 to render the blue data signal B (2 and 4).

Next, the sampling unit 200 samples the input data (ID2_4, ID2_5, ID2_6, ID3_4, ID3_5, and ID3_6) included in the 3×3 sampling window SW10 among the input data stored to the first and second line buffers 110 and 120 to generate the red data signal R (2 and 5) and the input data (ID4_4, ID4_5, and ID4_6) of the third line 130 to generate the sampling data SD10.

The red/green filter 310 red-filters the sampling data SD10 to render the red data signal R (2 and 5).

By this method, while the 3×3 sampling window is sequentially shifted by one pixel unit, the sampled sampling data is filtered with the corresponding color through the filters such that all data signals of the next line of the SPR pixel structure are rendered.

The source buffer 400 may transmit the data signals generated for each line to the frame memory.

The size of the sampling window was set up as 3×3, and thereby the number of line buffers including the line buffer portion 100 is set as 2 that is smaller than the size of the window by one, however the present invention is not limited thereto. The number of line buffers may be the same as the size of the window, however a minimizing method considering the size of the line buffer is described in the exemplary embodiment.

That is, the line buffer of the line buffer portion according to an exemplary embodiment may be set up as a number of less than the size of at least the sampling window by one. Furthermore, the size of the sampling window may be more than 3×3.

By way of summation and review, one or more embodiments provides a sub-pixel rendering structure that minimizes an increase of a number of gate wires and source wires, decreases complexity of a wire arrangement, and prevents deterioration of an image quality.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS red sub-pixel RPX, green sub-pixel GPX, blue sub-pixel BPX gate wire G1 and G2, source wire (S1-S10), pixel circuit P11 switching transistor TS, driving transistor TR), storage capacitor CS organic light emitting diode (OLED), pixel (11, 12, 21, 22), data rendering device 10 line buffer portion 100, 3×3 sampling unit 200, rendering unit 300, source buffer 400 first to third line buffer 110, 120, and 130, red/green filter 310 blue filter 320

What is claimed is:

1. A data rendering device for rendering a plurality of data signals for a first sub-pixel of a first color, a second sub-pixel and a third sub-pixel of a second color positioned in a first diagonal direction with respect to the first sub-pixel, and a fourth sub-pixel and a fifth sub-pixel of a third color positioned in a second diagonal direction with respect to the first sub-pixel, using input data for a plurality of pixels arranged with a stripe pattern, the data rendering device comprising:

a line buffer portion to store a number of lines of the input data to be rendered into a first data signal, a second data signal, and a third data signal;

a sampler to read the input data from the line buffer portion and to generate sampling data while at least one sampling window is sequentially shifted by a pixel unit, wherein the at least one sampling window has a predetermined size; and a rendering signal generator to perform second color-filtering of first sampling data among the sampling data that are sequentially generated to generate the second data signal, third color-filtering of second sampling data next to the first sampling data among the sampling data to generate the third data signal, and first color-filtering of third sampling data included in one of the first sampling data and the second sampling data to generate the first data signal, wherein:

the line buffer portion includes a plurality of line buffers, the plurality of line buffers are to respectively store one or more lines of the input data, and a line number of the plurality of line buffers is smaller than a line number of the at least one sampling window by one.

2. The data rendering device of claim 1, wherein the sampler is to sample the input data included in a first sampling window among the input data stored in the plurality of line buffers and the input data included in the first sampling window among the input data that is currently input to generate the sampling data.

3. The data rendering device of claim 1, wherein a first sampling window to generate the first data signal is smaller than second and third sampling windows to respectively generate the second and third data signals.

4. The data rendering device of claim 1, wherein a first period for rendering the first data signal at least partially overlaps a second period for rendering one of the second data signal and the third data signal.

5. The data rendering device of claim 4, wherein the rendering signal generator includes:

a first filter to perform second color-filtering of first sampling data to render the second data signal and to perform third-color filtering of second sampling data to render the third data signal;

a second filter to perform first-color filtering of one of the first sampling data and the second sampling data to render the first data signal, and wherein the first period in which the first filter is operated and the second period in which the second filter is operated are at least partially overlap.

6. The data rendering device of claim 5, wherein the second filter is included in one of the first sampling data and the second sampling data, and is to second-color filter the input data using a window that is smaller in size than a size of a sampling window adjacent to the first sub-pixel.

7. The data rendering device of claim 5, wherein:

when a pixel circuit of the first sub-pixel, a pixel circuit of the second sub-pixel, and a pixel circuit of the fourth sub-pixel are connected to a first gate wire, and a pixel circuit of the third sub-pixel and a pixel circuit of the fifth sub-pixel are connected to a second gate wire next to the first gate wire, and the first period in which the first filter is to render the second data signal and the second period in which the second filter is to render the first data signal at least partially overlap.

8. The data rendering device of claim 5, wherein:

when a pixel circuit of the second sub-pixel a the pixel circuit of the fourth sub-pixel are connected to a first gate wire, and a pixel circuit of the first sub-pixel, a pixel circuit of the third sub-pixel, and a pixel circuit of the fifth sub-pixel are connected to a second gate wire next to the first gate wire, and the first period in which the first filter is to render the third data signal and the second period in which the second filter is to render the first data signal are at least partially overlap.

* * * * *